US009934765B2

(12) United States Patent
Chandontrikij

(10) Patent No.: US 9,934,765 B2
(45) Date of Patent: Apr. 3, 2018

(54) CONGA SIDE PLATE

(71) Applicant: CHAN MUSICAL CO., LTD., Bangkok (TH)

(72) Inventor: Krisakorn Chandontrikij, Bangkok (TH)

(73) Assignee: CHAN MUSICAL CO., LTD., Bangkok (TH)

( * ) Notice: Subject to any disclaimer, the term of this patent is extended or adjusted under 35 U.S.C. 154(b) by 0 days.

(21) Appl. No.: 14/881,429

(22) Filed: Oct. 13, 2015

(65) Prior Publication Data

US 2017/0103738 A1 Apr. 13, 2017

(51) Int. Cl.
*G10D 13/02* (2006.01)

(52) U.S. Cl.
CPC ..... *G10D 13/023* (2013.01)

(58) Field of Classification Search
CPC ..... G10D 13/026; G10D 13/02; G10D 13/00; G10D 13/021; G10G 5/00; G10G 7/00
USPC ..... 84/411 R, 413, 421
See application file for complete search history.

(56) References Cited

U.S. PATENT DOCUMENTS 6,700,045 B2 * 3/2004 Del Valhe ..... G10D 13/023 84/411 A
7,402,740 B2 * 7/2008 van der Meulen .. G10D 13/023 84/411 R
8,609,967 B2 * 12/2013 Simons ..... G10D 13/023 84/411 R

* cited by examiner

*Primary Examiner* — Kimberly Lockett
(74) *Attorney, Agent, or Firm* — Cantor Colburn LLP

(57) ABSTRACT

A side plate configured for use on a percussion instrument includes a base plate having a first surface and a second surface. A receiving portion is configured to removably connect to the base plate. The receiving portion extends beyond the second surface of the base plate when connected thereto. The receiving portion includes a hole extending parallel to the first and second surface of the base plate. A tuning rode is receivable within the hole and is configured to restrict movement of the receiving portion relative to the base plate.

17 Claims, 3 Drawing Sheets

CONGA SIDE PLATE

BACKGROUND

This disclosure relates generally to percussion instruments, and more particularly, to a side plate of a tuning assembly of a percussion instrument and method for manufacturing such a side plate.

Various types of drums are known in the art of musical instruments. For example, the conga is a tall, narrow, single headed drum. Most modern congas have a staved fiberglass shell and a screw tensioned drumhead. They are usually played in multiples with the fingers and palms of the hand. Many drums, such as the conga, include a skin which is drawn over the open top and/or bottom of a drum body and is attached to the exterior of the drum body by tacks or hooks received by a side plate assembly. Conventional side plate assemblies include a plurality of components that are welded together to restrict movement of the tack or hook relative to the drum shell.

SUMMARY

According to a first embodiment, a side plate configured for use on a percussion instrument includes a base plate having a first surface and a second surface. A receiving portion is configured to removably connect to the base plate. The receiving portion extends beyond the second surface of the base plate when connected thereto. The receiving portion includes a hole extending parallel to the first and second surface of the base plate. A tuning rod is receivable within the hole and is configured to restrict movement of the receiving portion relative to the base plate.

In addition to one or more of the features described above, or as an alternative, in further embodiments the receiving portion is generally U-shaped.

In addition to one or more of the features described above, or as an alternative, in further embodiments the base plate includes a central opening into which the receiving portion is insertable.

In addition to one or more of the features described above, or as an alternative, in further embodiments the receiving portion includes at least one flange. The at least one flange is configured to abut the second surface of the base plate when the receiving portion and the base plate are connected.

In addition to one or more of the features described above, or as an alternative, in further embodiments an inlet is formed in the second surface of the base plate, the inlet being generally complementary to the at least one flange.

In addition to one or more of the features described above, or as an alternative, in further embodiments when the receiving portion is connected to the base plate, the at least one flange is disposed within the inlet such that the receiving portion and the second surface of the base plate are substantially flush.

In addition to one or more of the features described above, or as an alternative, in further embodiments the first surface of the base plate is configured to mount about an outer periphery of the percussion instrument.

In addition to one or more of the features described above, or as an alternative, in further embodiments the receiving portion is slidably movable relative to the base plate when the side plate is mounted to the drum.

According to another embodiment, a side plate configured for use one a percussion instrument includes a base plate having a first surface and a second surface. A receiving portion is integrally formed with and extends beyond the second surface of the base plate. The receiving portion includes a hole extending parallel to the first and second surface of the base plate configured to receive a tuning rod.

In addition to one or more of the features described above, or as an alternative, in further embodiments the base plate and the receiving portion are formed from a metal material.

In addition to one or more of the features described above, or as an alternative, in further embodiments a thickness of the base plate is substantially identical to a thickness of the receiving portion.

In addition to one or more of the features described above, or as an alternative, in further embodiments the receiving portion is generally U-shaped.

In addition to one or more of the features described above, or as an alternative, in further embodiments the side plate is substantially symmetrical about a vertical plane.

According to another embodiment, a method of mounting a side plate to a percussion instrument is provided including aligning the side plate about an outer periphery of the percussion instrument. The side plate includes a base plate and a receiving portion. The side plate is then affixed to a surface of the percussion instrument.

In addition to one or more of the features described above, or as an alternative, in further embodiments slidably inserting the receiving portion into an opening formed in the base plate.

In addition to one or more of the features described above, or as an alternative, in further embodiments inserting a tuning rod through a hole formed in a receiving portion of the side plate and applying tension to the tuning rod.

In addition to one or more of the features described above, or as an alternative, in further embodiments the method does not include welding the receiving portion to the base plate.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
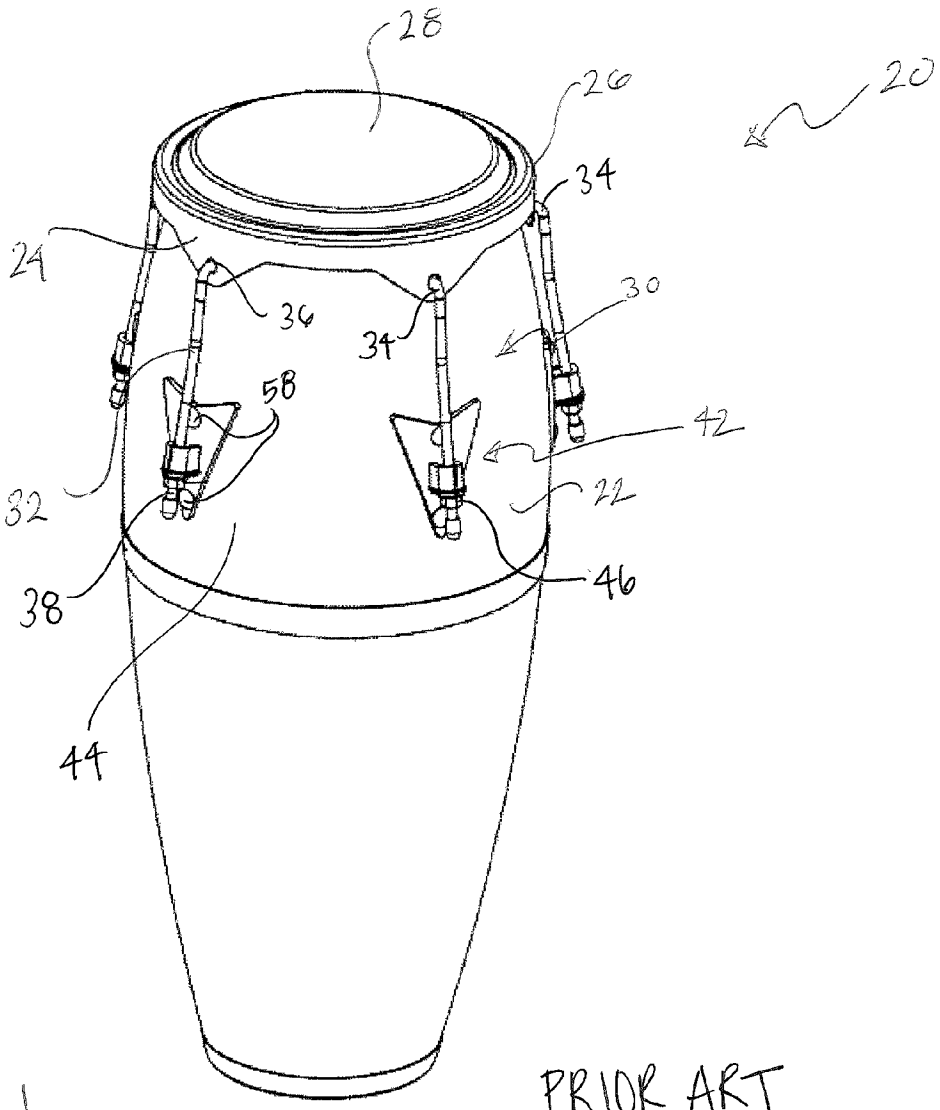
PRIOR ART FIG. 1
FIG. 1 is an example of a percussion instrument.

With reference to FIG. 1, an example of a hand percussion instrument 20, such as a conga drum, is illustrated. As shown, the drum 20 includes an elongated drum shell or body 22 having an open playing end (not shown). The drum body 22 may be formed from any suitable material, including but not limited to wood, fiberglass, and pvc for example. A skin 24, for example formed from a synthetic material, overlaps the open end of the body 22 and is maintained in position in a conventional manner with a ring 26. The portion of the skin 24 contained within the hollow interior of the ring 26, also referred to as the drum head 28, is the portion of the drum 20 that a person is configured to hit with a hand or other utensil to generate a desired sound. A plurality of tuning assemblies 30 spaced substantially equidistantly about the periphery of the drum shell 22 are configured to apply tension to the ring 26 such that the skin 24 is drawn across the open end of the drum shell 22.

Each tuning assembly 30 includes a tuning rod 32 having a first end 34, for example including a hook, receivable within a corresponding hole 36 formed in the ring 26. A second, opposite end 38 of the tuning rod 32 is configured to extend through an opening or hole 40 (see FIGS. 2 and 3) formed in a side plate 42 mounted to the exterior surface 44 of the drum shell 22. A nut 46 is configured to thread onto the second end 38 of the tuning rod 32 and may be selectively moved to adjust the tuning of the drum 20 by applying greater or lesser tension to the drum head 28 through the ring 26. For example, by tightening the nut 46, the tuning rod 32, and therefore the ring 26, is drawn downward causing the skin 24 to stretch across the open playing end of the drum shell 22.

Figure 2B:
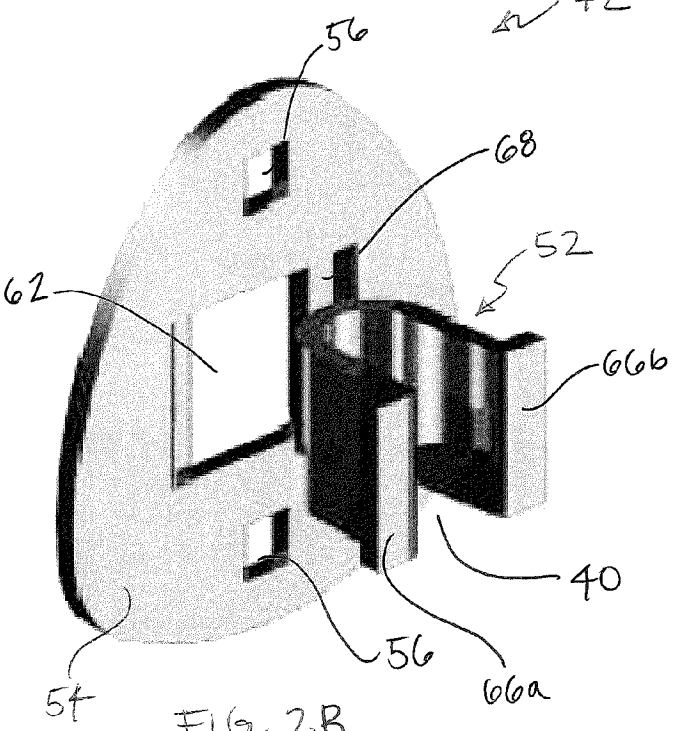
FIGS. 2A and 2B are front and back perspective views of a side plate of a tuning assembly of the percussion instrument of FIG. 1 according to an embodiment.
Figure 2A:
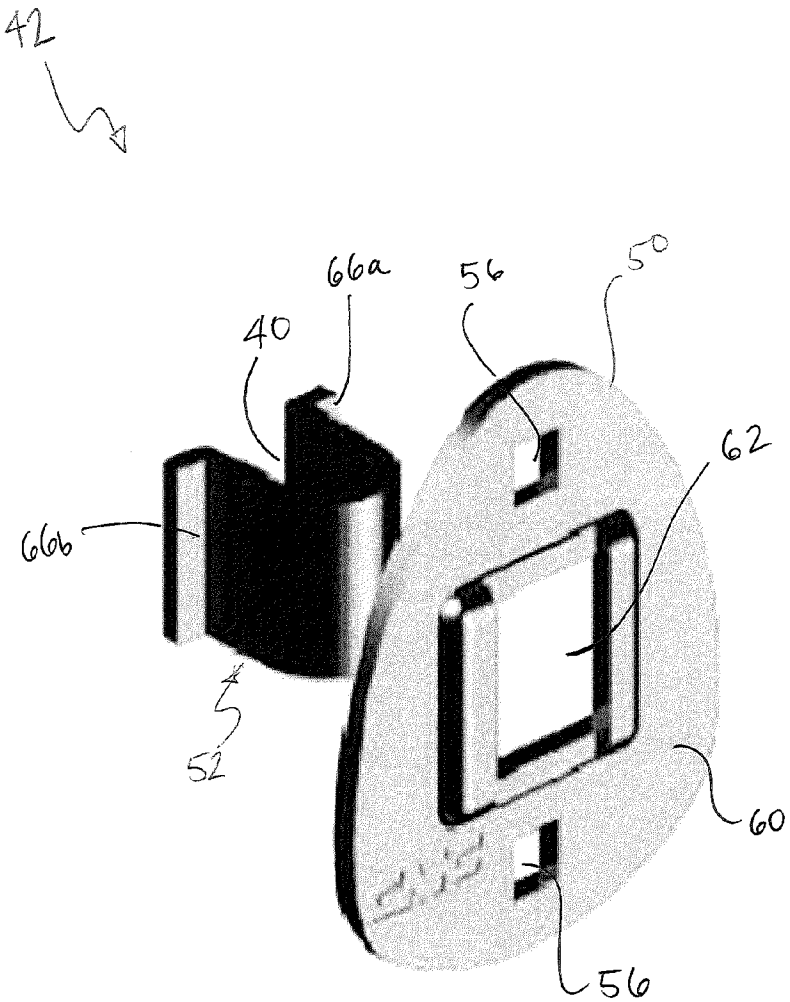
Figure 3:
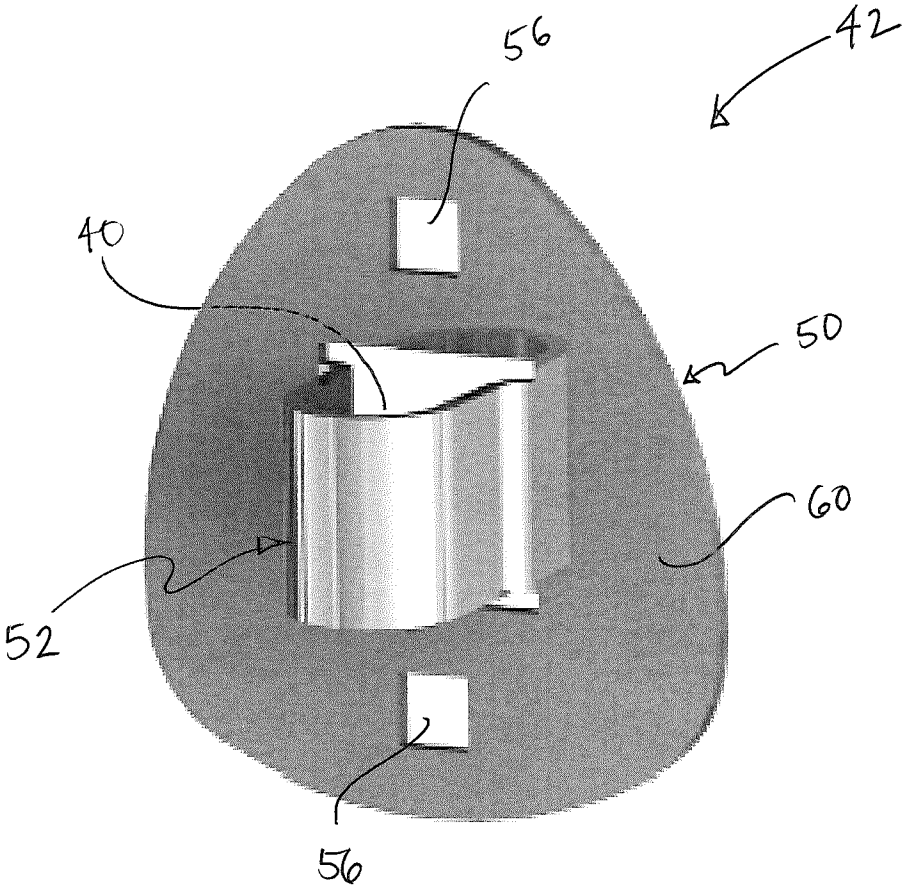
FIG. 3 is a side plate of a tuning assembly of the percussion instrument of FIG. 1 according to another embodiment.

Referring now to FIGS. 2 and 3, a side plate 42 of the tuning assembly 30 of a percussion instrument is illustrated in more detail. Although the side plate 42 is illustrated and described with respect to a conga drum, other percussion instruments, including, but not limited to hand drums, such as a djembe, bongo, or straight walled drum for example, are also within the scope of the invention. As illustrated, the side plate 42 includes a base plate 50 and a receiving portion 52. In one embodiment, one or both of the base plate 50 and the receiving portion 52 are formed from a suitable metal material. In addition, the base plate 50 and the receiving portion 52 may be formed from identical or different materials.

The base plate 50 has a first, generally planar surface 54 configured to contact an exterior 44 of the drum shell 22. In the illustrated, non-limiting embodiments, at least one opening 56 formed in the base plate 50 is configured to receive a fastener 58 (see FIG. 1), such as a bolt or screw for example, to affix the base plate 50 about the outer periphery of the drum shell 22. However, in other embodiments, the base plate 50 may be attached to the drum shell 22 with an adhesive or other bonding agent suitable for use in percussion instruments.

The receiving portion 52 protrudes beyond a second, opposite surface 60 of the base plate 50. The receiving portion 52 is generally U-shaped and therefore defines the hole 40 oriented substantially parallel to the plane of the base plate 50, and that is configured to receive the tuning rod 32. The hole 40 in the receiving portion 52 is at least equal to the size of the tuning rod 32 such that the second end 38 of the tuning rod 32 extends there through. In one embodiment, the side plate 42 is substantially symmetrical about a vertical plane.

In the non-limiting embodiment illustrated in FIGS. 2*a* and 2*b*, the receiving portion 52 is a separate component configured to removably connect to the base plate 50. The base plate 50 includes a centrally located opening 62 through which a part of the receiving portion 52 extends. As shown, the open end 64 of the receiving portion 52 includes at least one flange 66, for example a first flange 66*a* and a second flange 66*b*, extending horizontally outwardly, parallel to the plane defined by the hole 40 and the base plate 50. The at least one flange 66 is configured to contact a portion of the base plate 50, such as the first surface 54 for example, to restrict movement of the receiving portion 52 relative to the base plate 50. In one embodiment, an inlet 68 is formed in the first surface 54 of the base plate 50. The inlet 68, which may be formed via a punching or stamping operation, has a contour complementary to the one or more flanges 66 of the receiving portion 52 such that when the receiving portion 52 is connected to the base plate 50, a surface of the receiving portion 52 is substantially flush with the first surface 54 of the base plate 50.

When a side plate 42 having a separate receiving portion 52 and base plate 50 is mounted to the drum shell 22, the receiving portion 52 is positioned in an overlapping relationship between the drum shell 22 and the base plate 50. However, the receiving portion is slidably connected to the base plate, and relative movement of the receiving portion is restricted by the tuning rod 32. The threaded nut 46 connected to the tuning rod 32 extending through the hole 40 in the receiving portion 52 applies tension to the side plate 50. This tension generated by the tuning rod 32 further restricts sliding movement of the receiving portion 52 relative to the base plate 50.

In another embodiment, illustrated in FIG. 3, the receiving portion 52 and the base plate 50 of the side plate 42 are integrally formed from a single piece of material, such as sheet metal for example. The thickness of the receiving portion 52 may, but need not be substantially identical to the thickness of the base plate 50. The side plate 42 may be formed by stamping or punching the material to form both the base plate 50 and the receiving portion 52 protruding perpendicularly outward therefrom.

The side plates 42 described herein are easier and more cost effective to manufacture than conventional side plate assemblies. In addition, the time required to install the side plates 42 about the exterior 44 of a drum shell 22 is significantly reduced by eliminating the step of welding the receiving portion to the base plate that is necessary in common side plate installations and has been used for decades.

While the present disclosure has been particularly shown and described with reference to the exemplary embodiments as illustrated in the drawing, it will be recognized by those skilled in the art that various modifications may be made without departing from the spirit and scope of the present disclosure. Therefore, it is intended that the present disclosure not be limited to the particular embodiment(s) disclosed as, but that the disclosure will include all embodiments falling within the scope of the appended claims.

What is claimed is:

1. A side plate configured for use on a percussion instrument, comprising:

a base plate having a first surface and a second surface and an opening extending from the first surface to the second surface; and a receiving portion configured to removably connect to the base plate, the receiving portion being positionable adjacent the first surface such that part of the receiving portion extends through the opening, the receiving portion includes a hole extending parallel to at least one of the first surface and the second surface of the base plate, wherein a tuning rod receivable within the hole is configured to restrict movement of the receiving portion relative to the base plate.

2. The side plate according to claim 1, wherein the receiving portion is generally U-shaped.

3. The side plate according to claim 1, wherein the base plate includes a central opening into which the receiving portion is insertable.

4. The side plate according to claim 3, wherein the receiving portion includes at least one flange, the at least one flange being configured to abut the second surface of the base plate when the receiving portion and the base plate are connected.

5. The side plate according to claim 4, wherein an inlet is formed in the second surface of the base plate, the inlet being generally complementary to the at least one flange.

6. The side plate according to claim 5, wherein when the receiving portion is connected to the base plate, the at least one flange is disposed within the inlet such that the receiving portion and the second surface of the base plate are substantially flush.

7. The side plate according to claim 1, wherein the first surface of the base plate is configured to mount about an outer periphery of the percussion instrument.

8. The side plate according to claim 1, wherein the receiving portion is slidably movable relative to the base plate when the side plate is mounted to the drum.

9. A side plate configured for use on a percussion instrument, comprising:

a base plate having a first surface and a second, opposite surface; and a receiving portion integrally formed with and extending beyond the second surface of the base plate, a hole being formed in the base plate as a result of formation of the receiving portion, wherein the receiving portion includes a hole extending parallel to at least one of the first surface and the second surface, the hole being configured to receive a tuning rod.

10. The side plate according to claim 9, wherein the base plate and the receiving portion are formed from a metal material.

11. The side plate according to claim 9, wherein a thickness of the base plate is substantially identical to a thickness of the receiving portion.

12. The side plate according to claim 9, wherein the receiving portion is generally U-shaped.

13. The side plate according to claim 9, wherein the side plate is substantially symmetrical about a vertical plane.

14. A method of mounting a side plate to a percussion instrument, comprising:

positioning a receiving portion adjacent a first surface of a base plate such that the receiving portion extends through an opening formed in the base plate and beyond a second, opposite surface of the base plate to form the side plate;

aligning the side plate about an outer periphery of the percussion instrument; and affixing the side plate to the percussion instrument.

15. The method according to claim 14, wherein positioning the receiving portion to the adjacent base plate further comprises slidably inserting the receiving portion into an opening formed in the base plate.

16. The method according to claim 14, wherein the method further comprises:

inserting a tuning rod through a hole formed in a receiving portion of the side plate; and applying tension to the tuning rod.

17. The method according to claim 14, wherein the method does not include welding the receiving portion to the base plate.

* * * * *